US007213709B2

(12) United States Patent
Moskovich et al.

(10) Patent No.: US 7,213,709 B2
(45) Date of Patent: May 8, 2007

(54) EASY OPEN PACKAGE

(75) Inventors: Robert Moskovich, East Brunswick, NJ (US); Alan Sorrentino, Cranbury, NJ (US)

(73) Assignee: Colgate-Palmolive Company, New York, NY (US)

( * ) Notice: Subject to any disclaimer, the term of this patent is extended or adjusted under 35 U.S.C. 154(b) by 129 days.

(21) Appl. No.: 10/894,837

(22) Filed: Jul. 20, 2004

(65) Prior Publication Data

US 2006/0016704 A1 Jan. 26, 2006

(51) Int. Cl.
*B65D 73/00* (2006.01)
*B65D 83/00* (2006.01)

(52) U.S. Cl. ..... 206/484; 206/362.2

(58) Field of Classification Search ..... 206/362.2, 206/461–463, 469–471, 484, 823; 132/319
See application file for complete search history.

(56) References Cited

U.S. PATENT DOCUMENTS 1,274,133 A 7/1918 Ausubel
1,465,642 A 8/1923 Keene
1,479,800 A 1/1924 Feldstein
1,494,950 A * 5/1924 Clark ..... 206/484
1,690,311 A 11/1928 Reich
1,864,874 A 6/1932 Voight
2,757,787 A 8/1956 Sergent
3,127,993 A 4/1964 Phipps
3,325,847 A 6/1967 Meranto
3,358,824 A * 12/1967 Stagnitto ..... 206/461
3,394,802 A 7/1968 Hershaft
3,403,776 A 10/1968 Denny
3,776,375 A 12/1973 Rohdin (Continued)

FOREIGN PATENT DOCUMENTS

GB 2 278 103 A 11/1994

(Continued)

*Primary Examiner*—Bryon P. Gehman
(74) *Attorney, Agent, or Firm*—Ellen K. Park

(57) ABSTRACT

A thermoformed package can be easily opened when it is comprised of a first enclosing section, an intermediate section, and a second enclosing section. The first enclosing section and second enclosing section are each bonded to the intermediate section about the periphery of the intermediate section to form the package. The package can have a hinge at the base of the first enclosing section and the second enclosing section. The intermediate section can be a plastic, a plastic containing laminate, a paper material such as a paperboard, or a paper containing laminate. The strength of the bond of at least one of the first enclosing section and the second enclosing section to the intermediate section being less than the shear strength of the material of the first enclosing section and the second enclosing section. Further when the intermediate section is a paper or a paper containing laminate the shear strength of the paper or the paper containing laminate is less than the shear strength of the first enclosing section or the second enclosing section. On an upper part of the package there is an area where the first enclosing section and the second enclosing section can be gripped to open the package. The package is easily opened by breaking the bond of the first enclosing section or second enclosing section to the intermediate section, or in the alternative when the intermediate section is a paper or paper containing material, delaminating the paper containing material.

18 Claims, 8 Drawing Sheets

U.S. PATENT DOCUMENTS

| | | | | | |
|---|---|---|---|---|---|
| 3,857,487 | A | | 12/1974 | Misslin | |
| 3,861,528 | A | | 1/1975 | Damuth | |
| 3,966,045 | A | | 6/1976 | Perdue | |
| 4,091,927 | A | | 5/1978 | Lunsford | |
| 4,285,430 | A | | 8/1981 | Caunt | |
| 4,499,353 | A | * | 2/1985 | Shields | 206/470 |
| 4,730,726 | A | | 3/1988 | Holzwarth | |
| 4,751,934 | A | * | 6/1988 | Moir et al. | 132/319 |
| 4,848,378 | A | * | 7/1989 | Moir et al. | 132/319 |
| D315,269 | S | | 3/1991 | Brazis | |
| 5,192,386 | A | * | 3/1993 | Moir et al. | 206/823 |
| 5,429,241 | A | | 7/1995 | Althaus | |
| D363,820 | S | | 11/1995 | Winge | |
| 5,562,112 | A | * | 10/1996 | Gunderman et al. | 132/319 |
| 5,566,693 | A | * | 10/1996 | Gunderman et al. | 206/823 |
| 5,584,388 | A | | 12/1996 | Johnson | |
| 5,629,060 | A | | 5/1997 | Garwood | |
| 5,647,941 | A | * | 7/1997 | Gunderman et al. | 206/823 |
| 5,690,130 | A | * | 11/1997 | Gunderman et al. | 206/823 |
| D394,806 | S | | 6/1998 | Budert | |
| 5,769,245 | A | | 6/1998 | Butler | |
| 5,953,885 | A | * | 9/1999 | Berman et al. | 53/431 |
| 6,010,462 | A | | 1/2000 | Stoermer, III | |
| 6,026,532 | A | | 2/2000 | Catanzaro | |
| 6,039,495 | A | * | 3/2000 | Zimmerman et al. | 206/463 |
| 6,059,112 | A | | 5/2000 | Dykstra et al. | |
| 6,140,802 | A | | 10/2000 | Lundell et al. | |
| 6,170,663 | B1 | * | 1/2001 | Glassman | 206/461 |
| 6,182,420 | B1 | * | 2/2001 | Berman et al. | 53/431 |
| 6,186,324 | B1 | | 2/2001 | Catterson | |
| 6,248,380 | B1 | * | 6/2001 | Kocher et al. | 206/484 |
| RE37,535 | E | | 2/2002 | Avery et al. | |
| D454,695 | S | | 3/2002 | Greene | |
| 6,371,294 | B1 | * | 4/2002 | Blaustein et al. | 206/362.2 |
| 6,691,872 | B1 | * | 2/2004 | Berman et al. | 206/484 |

FOREIGN PATENT DOCUMENTS

| | | |
|---|---|---|
| WO | WO 91/03400 A | 3/1991 |
| WO | WO 02/38470 A1 | 5/2002 |

* cited by examiner

EASY OPEN PACKAGE

FIELD OF THE INVENTION

This invention is directed to an easy open package. More particularly this invention is directed to an easy open thermoform package.

BACKGROUND OF THE INVENTION

Thermoformed packages are used to package a large number of products. These include cell phones, cell phone parts, hardware items, electronic devices, household items and personal care items such as combs, hairbrushes, curlers and oral care items such as toothbrushes. These packages can be of a self-supporting type or can be hung from a peg or hook. The advantages of such packages are their low cost, ease of display and the use of transparent packaging so that the product can be seen by the purchaser.

Thermoformed packages can have one section formed to a desired shape and the other side planar through the use of a backing card, or both sections can be formed to a shape. In the latter embodiment the package usually will hold and display a single three dimensional object. In the former embodiment the planar part can be a plastic or a paper such as paperboard.

A problem with many thermoformed packages is the opening of the packages. They very securely hold the packaged item to the extent that it can be difficult to open the package. To open the package a knife or a scissors may be needed. This invention provides an easy-opening feature for a thermoformed package. The package can be opened without the need for a knife or scissors or other implement.

BRIEF SUMMARY OF THE INVENTION

This invention is directed to an easy-opening thermoformed package. The package is comprised of a first enclosing section, an intermediate section, and a second enclosing section. The first enclosing section, and the second enclosing section can both be shaped or either can be planar. The intermediate section likewise can be shaped or planar and will have an adhesive at least on its periphery. This adhesive will be on each side. The intermediate section can be a plastic or a paper material, such as a paperboard.

In the packaging of an article it is placed in the thermoformed package at least supported in part by the first enclosing section, the intermediate section and/or second enclosing section. The periphery of the first enclosing section and the periphery of the second enclosing section are bonded to the periphery of the intermediate section by the adhesive on at least the periphery of the intermediate section. The article then is enclosed and sealed in the thermoformed package by the activation of the adhesive.

The adhesive bond between the intermediate section and the first enclosing section, and the intermediate section and the second enclosing section has a strength less than the shear strength of the material of the first enclosing section and the second enclosing section. Consequently the bond between the first enclosing section and the intermediate section, and/or the bond between the second enclosing section and the intermediate section will break upon an applied tension force of pulling one enclosing section away from another enclosing section.

The intermediate section can be a plastic, a plastic/plastic laminate, a paper material such as paperboard, a paper/plastic laminate or a plastic/paper/plastic laminate. The plastic usually will be a thermoplastic. When the intermediate section is a paper material, such as a paperboard, or a laminate containing a paper material it may delaminate upon the opening of the package to further assist in the ease of opening the package. Otherwise the adhesive between the intermediate section and the first enclosing section and/or between the second enclosing section and the intermediate section will yield. The adhesive is chosen so as to maintain the integrity of the package during shipping and display and sale but yield under tension when the first enclosing section and the second enclosing section are pulled away from the intermediate section.

The package can have a hinge connecting the first enclosing section and the second enclosing section. Such a package can be made using a male mold section with a heated plastic placed on the male section and the female mold section and vacuum drawing the heated plastic onto the male mold to produce the package. The package also can be made using a female mold section with a heated plastic placed on the female section and a vacuum applied to draw the heated plastic onto the female mold section to produce the package. Using these types of molds and molding processes the package can be made with a hinge between the first enclosing section and the second enclosing section. This hinge can be at the top or the bottom of these enclosing sections. However the hinge will be at the bottom for a self-supporting stand-up thermoformed package.

The package at the point of sale can hang on a hook or can be in a stand-up orientation. If displayed in a stand-up orientation the center of gravity of the packaged product preferably is clearly within the perimeter of the base of the package.

DETAILED DESCRIPTION OF THE INVENTION

The invention will be described in its preferred embodiments with reference to the drawings. The invention may be modified but such modifications will be within the present package concept.

Figure 1:
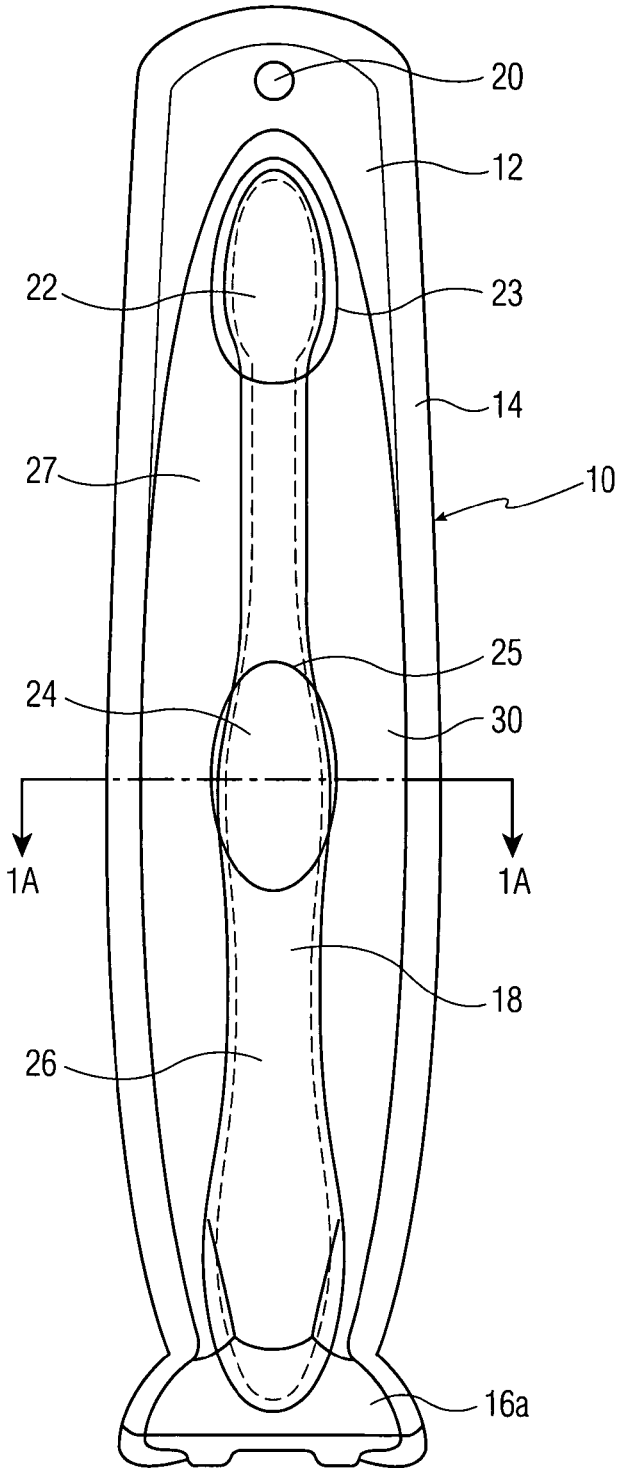
FIG. 1 is a front elevational view of the thermoformed package with a toothbrush.
Figure 2:
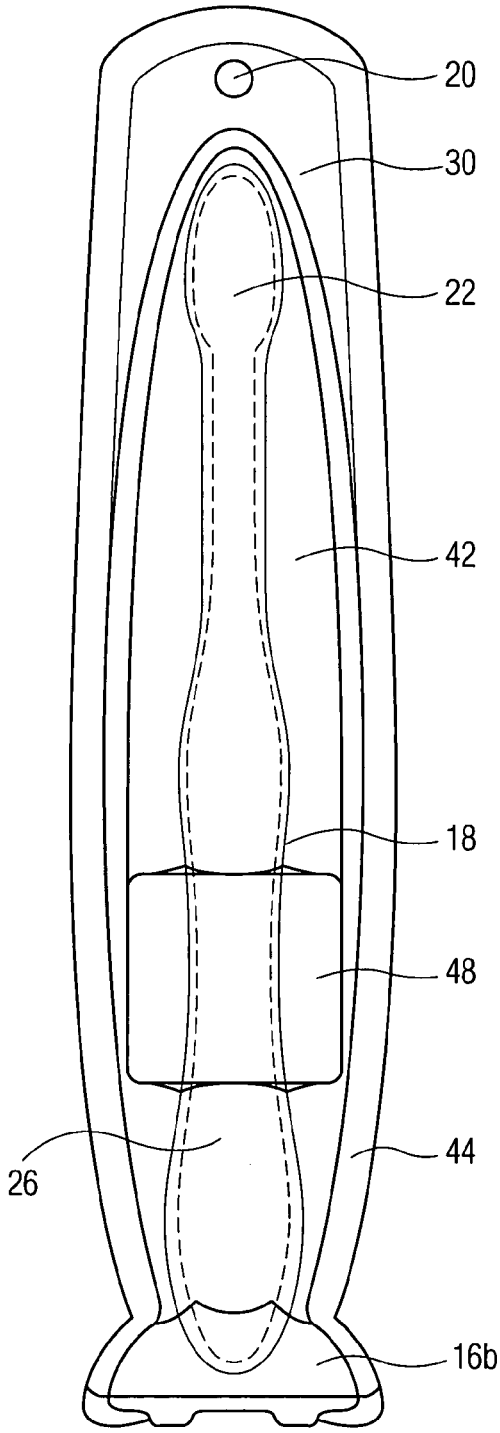
FIG. 2 is a rear elevational view of the thermoformed package of FIG. 1.

FIG. 1 is a front elevation view of the thermoformed package 10. The package 10 has a first enclosing section 12 with a surrounding peripheral edge 14. A second enclosing section 42 is shown in FIG. 2. There is a base section 16(*a*)

which in combination with a base section 16(*b*) (FIG. 2) will be sufficient in length and width to support the package in an upright orientation when on display. The package also can be hung from a pin or peg through aperture 20. Shown contained in package 10 is toothbrush 18. The toothbrush has a bristle area 22, thumb grip 24 and hand grip 26. The package has raised areas 23 and 25 to accommodate raised bristle area 22 and thumb grip 24 respectively. The surface 27 of the first enclosing section can be generally curved to accommodate the packaged toothbrush.

The package also will contain an intermediate section 30 which can be substantially planar sheet of plastic, paper, plastic/plastic laminate; plastic/foil laminate; plastic/paper laminate; plastic/paper/plastic laminate, plastic/paperboard laminate, plastic/paperboard/plastic laminate or solely paperboard. The intermediate section 30 will extend into the peripheral edge area 14. The intermediate section also can be in the form of a shaped sheet.

Figure 1A:
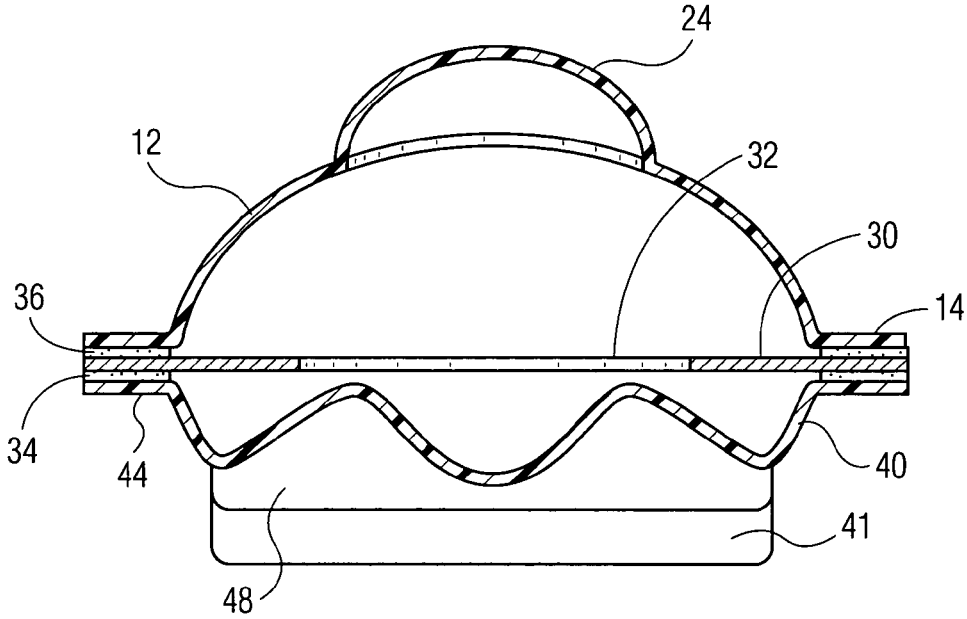
FIG. 1A is a cross-sectional view of the thermoformed package of FIG. 1 along line 1A–1A of FIG. 1.

FIG. 1A shows a cross-section of the package of FIG. 1 along line 1A–1A. There is shown first enclosing section 12 with raised area 24. The peripheral edge 14 of the first enclosing section 12 and the peripheral edge 44 of the second enclosing section are on either side of the intermediate section 30. The intermediate section is shown with an opening 32 to hold the toothbrush. The intermediate section has an adhesive layer 36 adjacent the first enclosing section 12 and adhesive layer 34 adjacent the second enclosing section 40.

FIG. 2 is a rear elevation view of the package 10. This is comprised of second enclosing section 42 with peripheral edge 44. There is a substantially planar area 48 for the UPC symbol and other information. It is preferred that the UPC symbol be planar, or near planar, for ease of scanning at the point of purchase. The film of the enclosing section 42 will be shaped to accommodate the article being packaged, like a toothbrush. The base portions 16(*a*) and 16(*b*) will be of a suitable length and width dimension to support the packaged product in a stand-up orientation.

Figure 3:
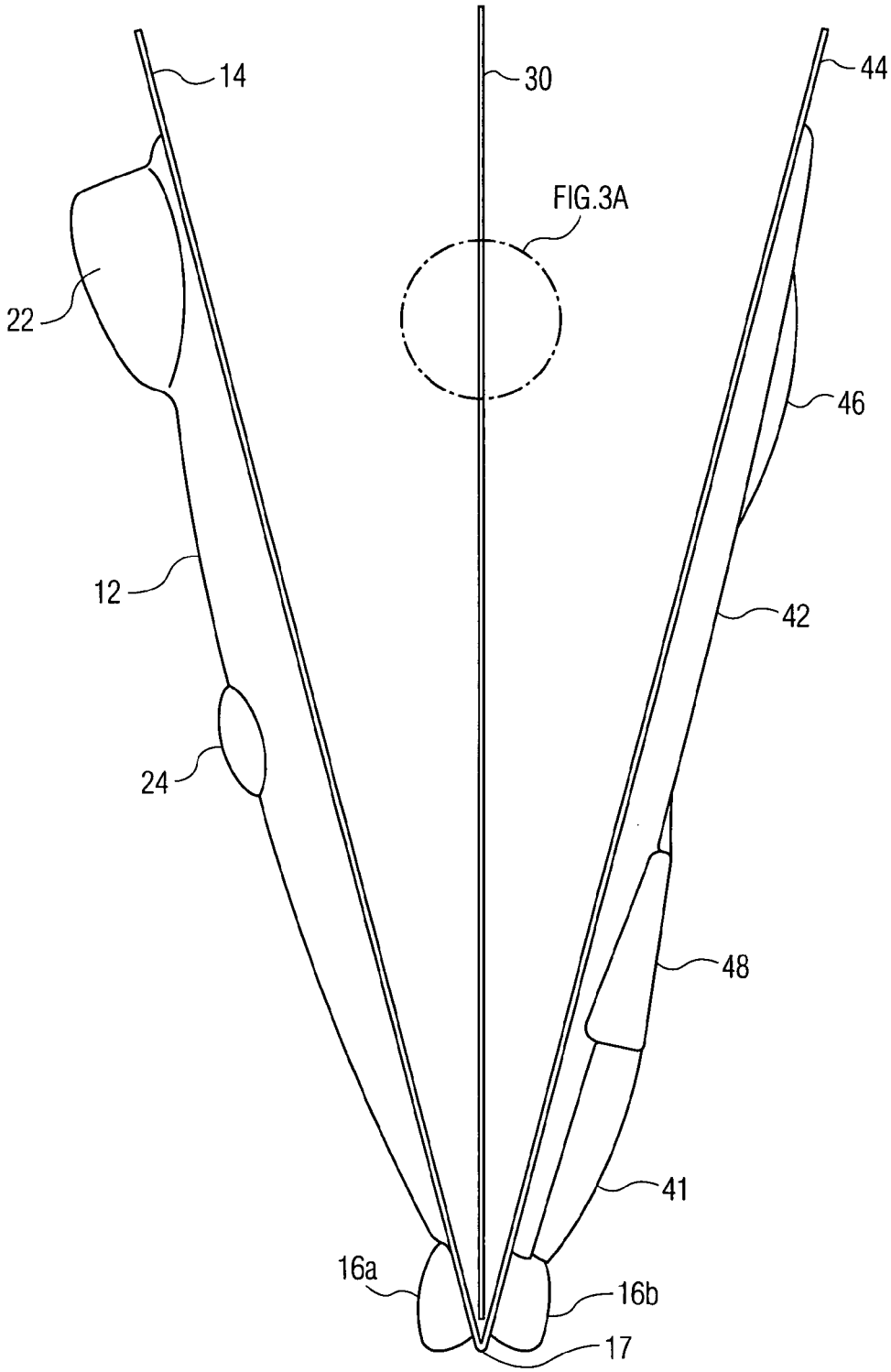
FIG. 3 is a side elevational view of the package in an open orientation prior to inserting a toothbrush.
Figure 3A:
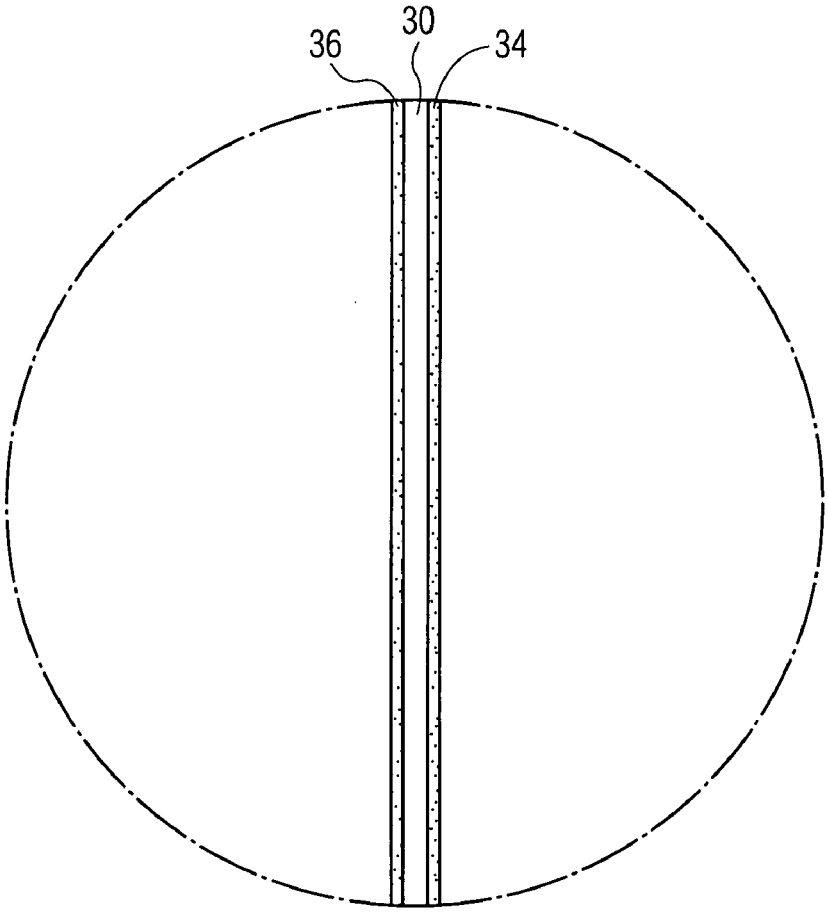
FIG. 3A is a cross-sectional view of the structure of the intermediate section.

FIG. 3 shows the package in a form to receive the article to be packaged, here a toothbrush. This is a side elevation view of the package not yet assembled. This view shows first enclosing section 12, intermediate section 30 and second enclosing section 42. The intermediate section 30 extends between peripheral edge 14 of the first enclosing section 12 and the peripheral edge 44 of the second enclosing section 42. A hinge 17 connects base portions 16(*a*) and 16(*b*). This intermediate section 30 will have an adhesive on substantially all of its periphery as is shown in FIGS. 1A and 3A. Here in FIG. 3A the intermediate layer 30 is shown with a layer 34 of adhesive on a first side and a layer of adhesive 36 on a second side. However an option is for the adhesive to be on the full surfaces of the intermediate layer 30.

In FIG. 3 the intermediate layer 30 will have shaped apertures to receive and hold the article to be packaged, like a toothbrush. Even with this aperture there will be sufficient space on the intermediate layer 30 for advertising and other descriptive information. In packaging a toothbrush the toothbrush is placed in intermediate layer 20. The intermediate layer 20 then is placed in the first enclosing section 12 and the second enclosing section 42 is folded over onto the first enclosing section by base hinge 17. The peripheral edge of the first enclosing section 12 and of the second enclosing section 42 then are each bonded to the intermediate layer to form a completed package.

Figure 4:
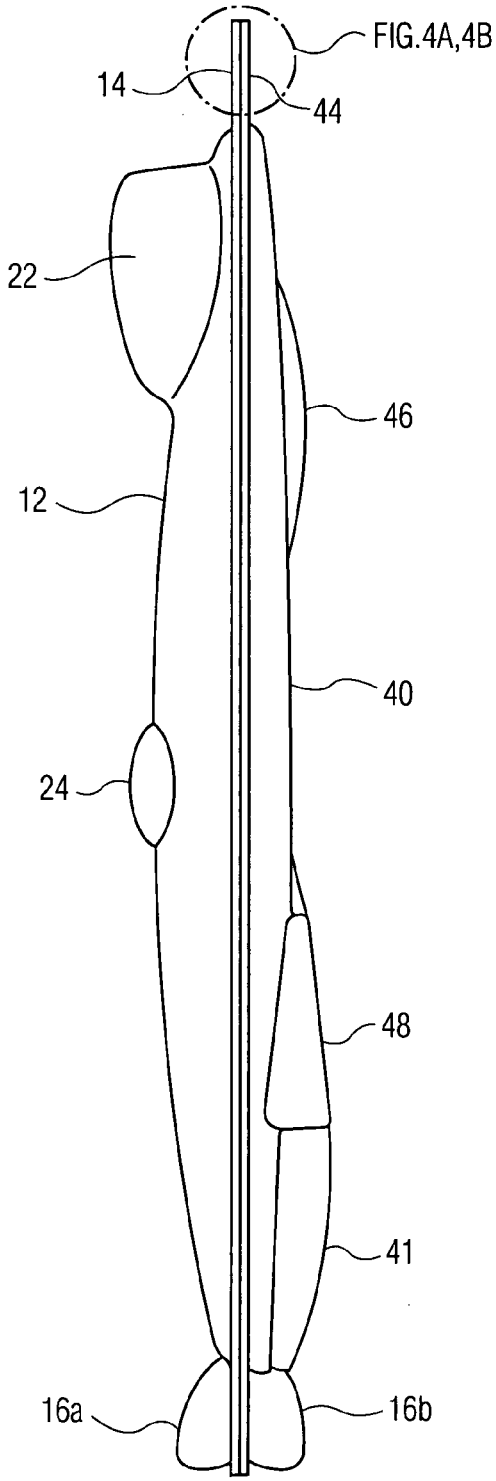
FIG. 4 is a side elevational view of the thermoformed package of FIG. 1.
Figure 4A:
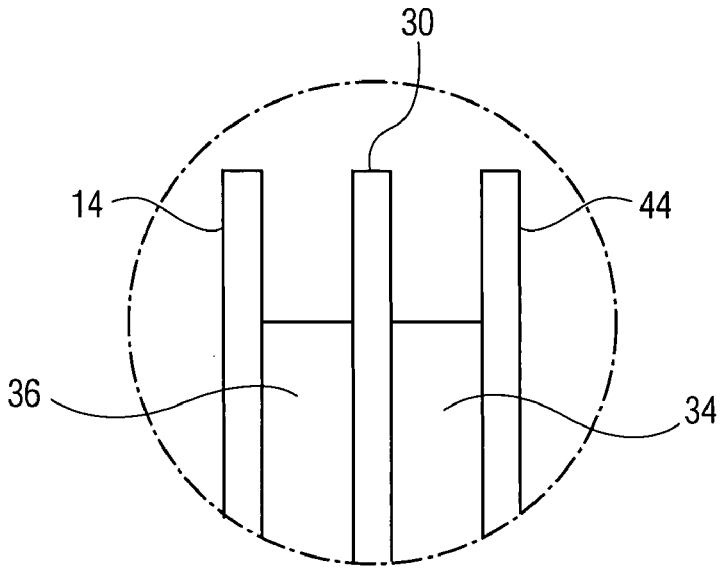
FIG. 4A is a cross-section view of the top of the package showing a separation of the first enclosing section and the second enclosing section.

FIG. 4 is a side elevation view of the toothbrush package. This view shows the parts of the first enclosing section of FIG. 1 and of the second enclosing section 42. However shown in more detail is the UPC label section 4B and the shaped section 41. There also is seen here the three layer edge of the first enclosing section 12, the second enclosing section 42 and the intermediate layer 30. Shown in FIG. 4A is a top edge of the package of FIG. 4. On portion 60 there is no adhesive on the peripheral edge of intermediate layer 30. In this area a person can grip the first enclosing section 12 and the second enclosing section 42 and pull them apart to open package 10. The first enclosing section 12 and on the second enclosing section 42 bond with intermediate section 30 will yield to open the package. And when the intermediate layer is a laminate containing paper or paperboard there can be a delamination of the paper or paperboard to open the package. This is a form of shear of the intermediate section 30. That is, there will be a shear of the adhesive at the interface of the first enclosing section and intermediate section interface, the second enclosing section and intermediate section interface, a shear of the intermediate section, or a combination of these shear to open the package. In any regards the foregoing shear force to open the package is less than the shear force of the material of the first enclosing section 12 and the second enclosing section 42. The force to shear these materials will be greater than the force to shear the adhesive bonds of the first enclosing section and second enclosing section to the intermediate section, or to shear the intermediate section. This results in a way to more easily open a thermoformed package.

Figure 4B:
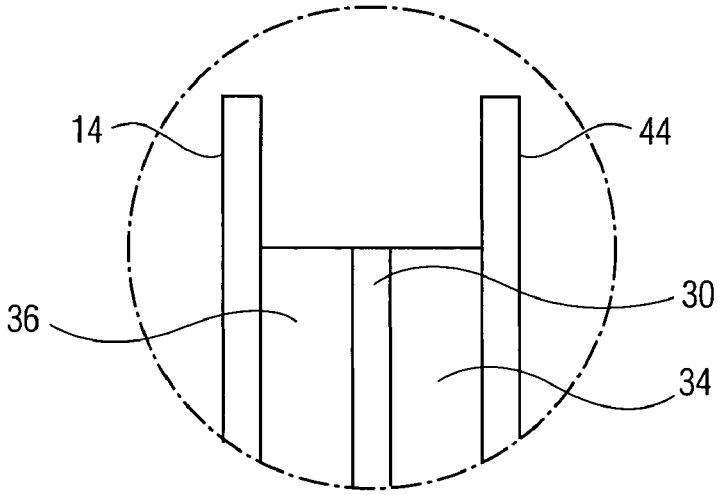
FIG 4B is a cross-section view of the top of the package of FIG. 4A with the intermediate section cut away in this area.

FIG. 4A is a cross-section of the top of the package showing a separation of the first enclosing section 12 and the second enclosing section 42. At a top part of the package there is no adhesive between the first section 12 and the second section 42 and the intermediate section 30. Further in order to enhance the opening the intermediate section will be cut-away at this area to better grip the first section 12 and the second section 42 to peel open the package. This is shown in FIG. 4B.

Figure 5:
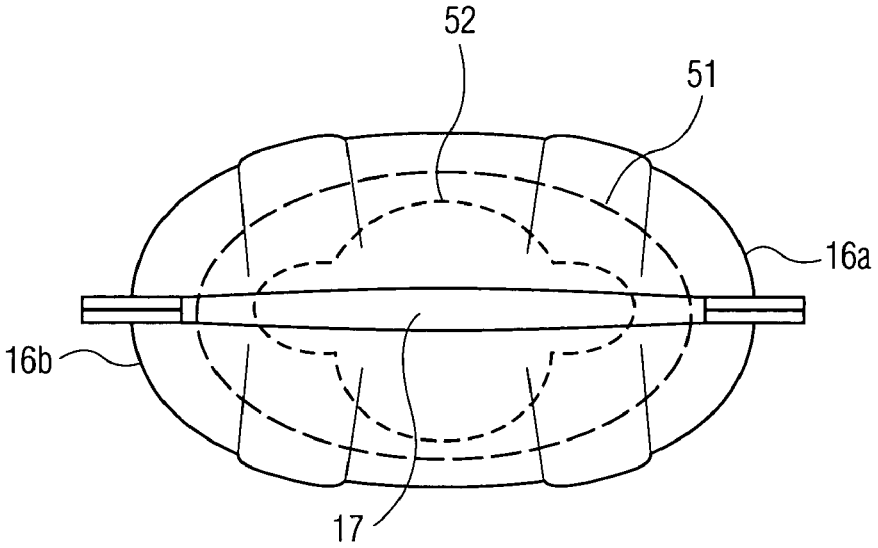
FIG. 5 is a plan view of the base dimension to provide for a stand-up thermoformed package.

The package also will have a hinge 17 at the base 16(*a*)/16(*b*) of the package and the base will be of a length and width versus height to be capable of stand-up orientation on a planar surface such as a store shelf. Also to be taken into consideration is the distribution of the weight of the packaged item. These all are factors that must be considered. The center of gravity of the packaged item should be within a shape of the base that is of about 80% and preferably about 60% of the length and width of the base as shown in FIG. 5. That is, the center of gravity should be within the area defined by the dashed line 51, and preferably within the area defined by the dashed line 52. The hinge is at the base and the easy open feature at an upper part of the package so as to provide for a stand-up orientation. The hinge is recessed in the base so as not to interfere with the stand-up orientation of the package.

The package is made by vacuum thermoforming using either a male or a female mold and using known thermoforming processes. In these processes a heated sheet of plastic is drawn onto the mold by a vacuum. There can be on assist by an insert pad to assure that the heated plastic makes a close contact with the mold surface. After shaping to the contour of the mold surface the new shaped plastic sheet is removed from the mold, cooled and along with an intermediate section available to package an article such as a toothbrush.

The plastic used for forming the first enclosing section 12 and second enclosing section 42 can be any thermoplastic commonly used for thermoforming. These include polymers and copolymers of ethylene, propylene, butene, and butadiene. Essentially any known and commonly used thermoforming polymers can be used.

What is claimed is:

1. A package for an article comprising a first enclosing section, a second enclosing section and an intermediate section disposed between the first enclosing section and the second enclosing section, the first enclosing section and the second enclosing section each having a peripheral edge, the intermediate section extending between the peripheral edge of the first enclosing section and the peripheral edge of the second enclosing section, each of the peripheral edge of the first enclosing section and peripheral edge of the second enclosing section adhesively bonded to the intermediate section, the shear strength of the intermediate section is less than the shear strength of the material of the first enclosing section and of the material of the second enclosing section and of the adhesive bonding of each of the enclosing sections to the intermediate section whereby the intermediate section will primarily delaminate upon application of a force thereto to thereby open the package.

2. A package as in claim 1 wherein the material of the intermediate section contains a plastic.

3. A package as in claim 2 wherein the intermediate section contains a paper material.

4. A package as in claim 1 wherein the plastic of said first enclosing section and the second enclosing section is a thermoplastic.

5. A package as in claim 4 wherein the thermoplastic is selected from the group consisting of polymers and copolymers of ethylene, propylene, butene and butadiene.

6. A package as in claim 1 wherein the shear strength of the bond of the peripheral edge of the first enclosing section and of the second enclosing section to the intermediate section is less than the shear strength of the material of the first enclosing section and of the material of the second enclosing section.

7. A package as in claim 1 wherein the article contained in the package is a toothbrush.

8. A package as in claim 7 wherein the material of the intermediate section contains a plastic.

9. A package as in claim 1 wherein the material of the intermediate section contains a paper material.

10. A package as in claim 9 wherein the shear strength of the material of at least one of the first enclosing section and the second enclosing section is greater than the shear strength of the intermediate section.

11. A package as in claim 9 wherein the shear strength of the bond of the peripheral edge of the first enclosing section and of the second enclosing section to the intermediate section is less than the shear strength of the material of the first enclosing section and of the material of the second enclosing section.

12. A package as in claim 9 wherein the article contained in the package is a toothbrush.

13. A package as in claim 1 wherein the material of the intermediate section is comprised of a plastic and paper material laminate.

14. A package as in claim 1 wherein the material of the intermediate layer contains a paperboard.

15. A package as in claim 1 wherein the package has a base at a lower part and there is a hinge at the base of the package connecting the first enclosing section and the second enclosing section.

16. A package as in claim 15 wherein there is an opening grip at an upper part of the package.

17. A package as in claim 1 wherein there is an opening grip at an upper part of the package.

18. A package as in claim 1 wherein there is a base at a lower part of the package, the base of sufficient dimensions for the package to maintain a stand-up orientation.

* * * * *